US007000617B2

(12) United States Patent
Cervantes et al.

(10) Patent No.: US 7,000,617 B2
(45) **Date of Patent: *Feb. 21, 2006**

(54) CIGAR HOLDER

(75) Inventors: Chris A Cervantes, 27835 Higuera, Mission Viejo, CA (US) 92691; Neal Patel, La Habra, CA (US)

(73) Assignee: Chris A Cervantes, Mission Viejo, CA (US)

( * ) Notice: Subject to any disclaimer, the term of this patent is extended or adjusted under 35 U.S.C. 154(b) by 276 days.

This patent is subject to a terminal disclaimer.

(21) Appl. No.: 10/391,406

(22) Filed: Mar. 18, 2003

(65) Prior Publication Data

US 2004/0182402 A1 Sep. 23, 2004

(51) Int. Cl.
*A24F 13/22* (2006.01)

(52) U.S. Cl. ..... 131/187; 131/259

(58) Field of Classification Search ..... 131/257, 131/259, 240.1, 187, 191; D27/183, 172; D8/356
See application file for complete search history.

(56) References Cited

U.S. PATENT DOCUMENTS

| | | | | |
|---|---|---|---|---|
| 3,001,529 | A | 9/1961 | Watson | |
| 3,653,775 | A * | 4/1972 | Ross | 401/6 |
| 5,588,448 | A | 12/1996 | Photakis | |
| D379,551 | S | 5/1997 | Hubbard | |
| D380,862 | S | 7/1997 | Hasselgren | |
| D385,059 | S | 10/1997 | Jenkins | |
| 5,706,831 | A * | 1/1998 | Whitbeck | 131/187 |
| D392,410 | S | 3/1998 | Lukach | |
| D395,731 | S | 6/1998 | Olis | |
| 5,813,414 | A * | 9/1998 | Zutler et al. | 131/241 |
| D405,224 | S | 2/1999 | Falconio | |
| 6,350,510 | B1 * | 2/2002 | Konig et al. | 428/216 |
| 6,363,941 | B1 * | 4/2002 | Combs | 131/190 |
| D485,393 | S * | 1/2004 | Cervantes et al. | D27/183 |
| 2003/0000536 | A1 * | 1/2003 | Heffernan | 131/257 |
| 2003/0207721 | A1 * | 11/2003 | Hall et al. | 473/282 |

* cited by examiner

*Primary Examiner*—Steven P. Griffin
*Assistant Examiner*—Carlos Lopez

(57) ABSTRACT

The present invention is directed to devices for securely caddying elongated objects, such as cigars, above the ground. Generally, a device in accordance with the present invention includes an elongated shaft, a handle coupled to the top end of the elongated shaft, and a cradle coupled to the middle area of the elongated shaft.

6 Claims, 2 Drawing Sheets

CIGAR HOLDER

FIELD OF THE INVENTION

The present invention relates generally to golf accessories or equipment items, and more particularly to cigar caddies.

BACKGROUND OF THE INVENTION

It is common practice for golfers to smoke cigarettes or cigars while playing golf. When a smoking golfer prepares to take a golf swing or stroke, the golfer typically lays the lighted cigarette or cigar on the ground. However, this practice is unsanitary because the cigar or cigarette may be exposed to poisons or injurious chemicals on the ground, thus exposing the golfer to such hazards.

One solution is to use a golf smoke tee, which is a golf tee with a cradle on top for holding objects such as cigars or cigarettes above the ground. One such golf smoke tee is described in U.S. Pat. No. 3,001,529, filed May 9, 1958, issued to Watson. However, the golf smoke tee disclosed in the Watson patent is described as being about 1" to 2½" tall. This may pose problems for golfers who experience back problems. The golfer may need to strain his/her back to bend over and use such a golf smoke tee.

An alternative cigar holder is shown in U.S. Design Pat. No. D385,059, filed on Aug. 7, 1996, issued to Jenkins, which suggests a much taller vertical shank, but the Jenkins design patent does not a show or suggest a means for conveniently driving the holder securely into the ground.

Accordingly, an improved cigar caddy would be desirable.

SUMMARY OF INVENTION

The present invention is directed to devices for securely caddying elongated objects, such as cigars, above the ground. Generally, a device in accordance with the present invention includes an elongated shaft.

In accordance with a first aspect of the present invention, a handle may be coupled to the top end of the elongated shaft, and a cradle may be coupled to the middle area of the elongated shaft.

Other objects and features of the present invention will become apparent from consideration of the following description taken in conjunction with the accompanying drawings.

BRIEF DESCRIPTION OF THE DRAWINGS

In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENT

Figure 1:
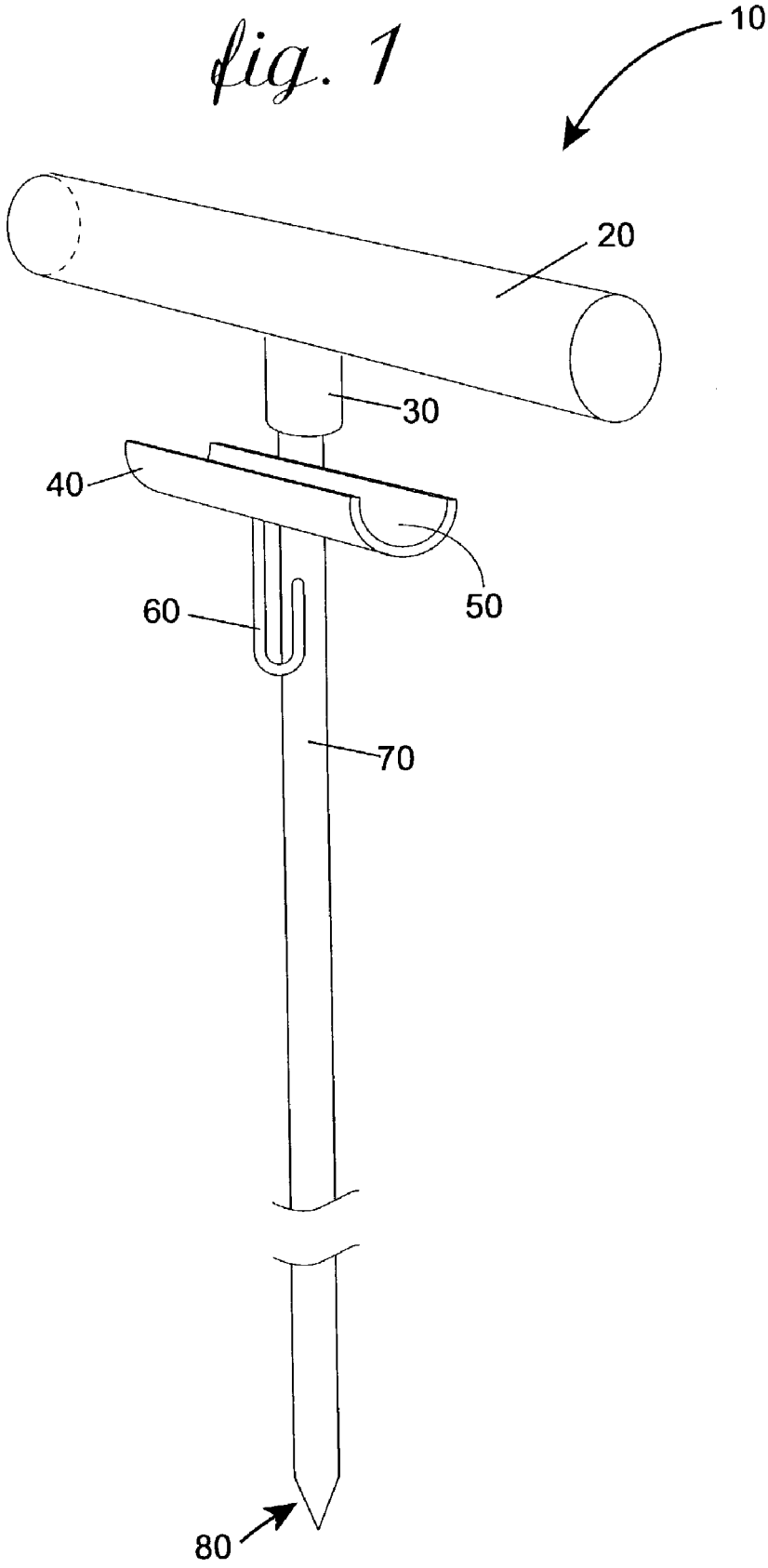
FIG. 1. is a perspective view of a cigar caddy in accordance with a preferred embodiment of the present invention.

Turning to FIG. 1, a cigar caddy 10 is constructed in accordance with a preferred embodiment of the present invention. The cigar caddy 10 includes an elongated shaft 70, which may be comprised of a sturdy material such as metal and/or plastic. The bottom end 80 of the shaft 70 is preferably tapered to allow the shaft 70 to be more easily driven into the ground. The shaft 70 may be of any length, preferably approximately waist high, e.g., approximately 3 feet to 5 feet. Having a shaft 70 approximately waist high allows a person to drive the shaft into the ground while minimizing back strain. Alternatively, the shaft 70 may be less than 3 feet in length, which allows the cigar caddy 10 to be more easily stored when not in use.

A cradle 40 is coupled with the shaft 70 via a U-shaped connector 60. The U-shaped connector is coupled to the shaft 70 in an area between the middle and the top of the shaft 70. The cradle 40 has a curved inner surface 50 that is exposed in the upward direction when the caddy 10 is in use. A smoking article such as a cigar or cigarette may be placed in the cradle 40 when a golfer no longer wants to hold his/her lighted cigar or cigarette. The inner surface 50 is preferably lined with a non-slip substance, such as a rubber material, which allows the smoking article to be better secured within the cradle 40.

A cylindrical handle 20 is coupled to the top of the shaft 70 via a cylindrical connector 30. The cylindrical handle 20 allows a person to more conveniently drive the shaft 70 into the ground. The handle 20 may be of a variety of shapes, e.g., the handle may be rectangular, oval, or the mold of a human grip.

Figure 2:
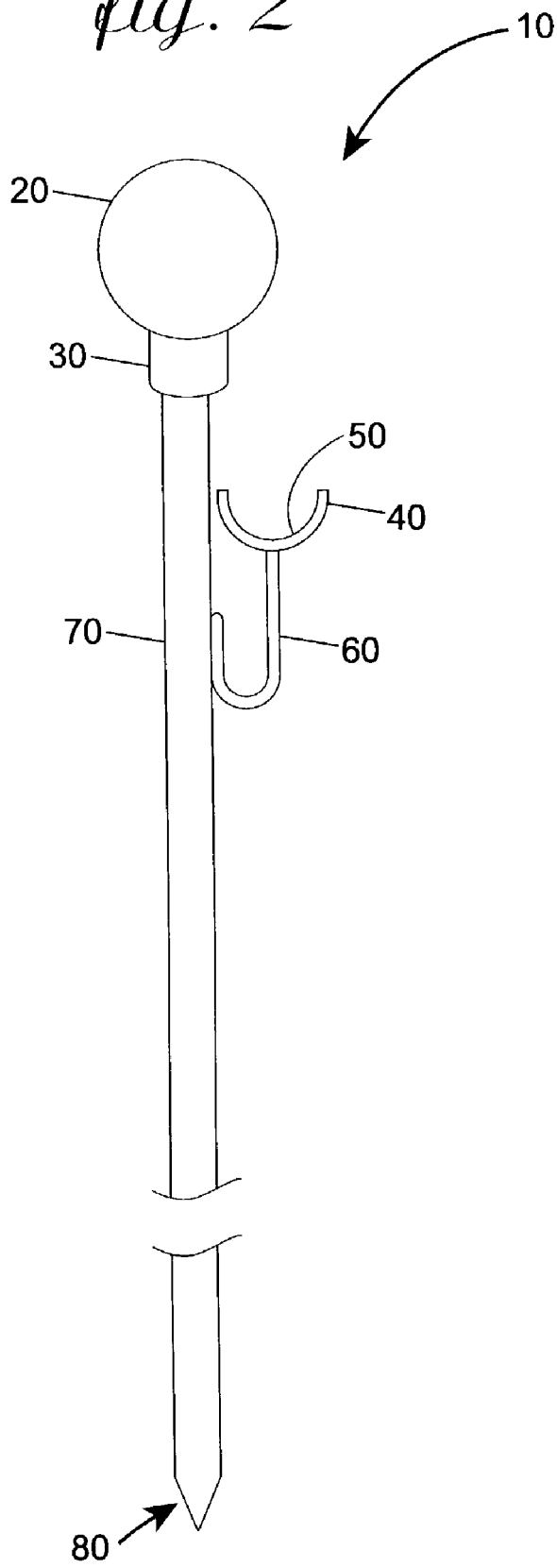
FIG. 2. is a side view of a cigar caddy in accordance with a preferred embodiment of the present invention.

Turning to FIG. 2, the side view of the cigar caddy 10 is shown. The cradle 40 is shown as a half-circle, and a smoking article may be placed on the inner surface 50 of the half circle.

While embodiments of the present invention have been shown and described, various modifications may be made without departing from the spirit and scope of the present invention, and all such modifications and equivalents are intended to be covered.

What is claimed is:

1. A cigar caddy comprising:

an elongated shaft having a top end, a bottom end, and a middle area, wherein the bottom end is tapered;

a generally cylindrical handle attached to the top end of said elongated shaft via a connector wherein the axis of the handle is positioned perpendicular to the axis of the elongated shaft;

a generally U-shaped elongated connector having a first and second ends, wherein the first end is shorter than the second end and wherein the first end is attached to the middle area of said elongated shaft; and an elongated cradle perpendicularly attached to the top of the second end of the generally U-shaped elongated connector, wherein the cross-sectional profile of the cradle is generally half-circle shaped.

2. The cigar caddy of claim 1, wherein said cradle is positioned closer to the top end than to the bottom end of said elongated shaft.

3. The cigar caddy of claim 1, wherein said elongated shaft has a length of approximately four feet.

4. The cigar caddy of claim 1, wherein the handle is a mold of a human grip.

5. The cigar caddy of claim 1, wherein said cradle has an inner surface and the inner surface is lined with a non-slip substance.

6. The cigar caddy of claim 5, wherein the inner surface is lined with rubber.

* * * * *